United States Patent [19]

Bartlett et al.

[11] 4,356,701

[45] Nov. 2, 1982

[54] CRYOPUMP

[75] Inventors: Allen J. Bartlett, Milford; Robert M. Lewis, Hudson, both of Mass.

[73] Assignee: Helix Technology Corporation, Waltham, Mass.

[21] Appl. No.: 266,186

[22] Filed: May 22, 1981

[51] Int. Cl.[3] ..... B01D 8/00

[52] U.S. Cl. ..... 62/55.5; 55/269; 165/104.21; 417/901

[58] Field of Search ..... 62/55.5, 6, 514 R; 165/104.21; 417/901; 55/269

[56] References Cited

U.S. PATENT DOCUMENTS

| | | | |
|---|---|---|---|
| 2,703,673 | 3/1955 | Winkler | 62/55.5 |
| 3,081,068 | 3/1963 | Milleron | 62/55.5 |
| 3,218,815 | 11/1965 | Chellis et al. | 62/6 |
| 3,433,297 | 3/1969 | Kohler | 62/55.5 |
| 3,850,001 | 11/1974 | Locke | 165/104.21 |
| 4,212,170 | 7/1980 | Winkler | 62/55.5 |
| 4,266,959 | 5/1981 | Welch | 62/55.5 |
| 4,277,951 | 7/1981 | Longsworth | 62/55.5 |

*Primary Examiner*—Ronald C. Capossela

*Attorney, Agent, or Firm*—Hamilton, Brook, Smith and Reynolds

[57] ABSTRACT

For a given temperature differential between a refrigerated heat sink and frontal cryopanel array, the mass of the entire cryopump array is minimized by providing thermal struts between the heat sink and the frontal array. The thermal struts extend through, but are isolated from, the primary pumping surface to minimize their lengths. The struts support the frontal array independent of the side radiation shield to facilitate fabrication. To further reduce the temperature differential to the frontal array, heat pipes may be provided. By reducing the temperature differential between the frontal cryopanel array and refrigerated heat sink through the use of solid thermal struts or heat pipes the load carrying capability of a cryopump can be improved. Heat pipes may also serve as a thermal switch between a heat sink and a cryopanel.

11 Claims, 3 Drawing Figures

CRYOPUMP

TECHNICAL FIELD

This invention relates to cryopumps and has particular application to cryopumps cooled by two stage closed cycle coolers.

BACKGROUND

Cryopumps currently available, whether cooled by open or closed cryogenic cycles, generally follow the same design concept. A low temperature surface, usually operating in the range of 4 to 25 K, is the primary pumping surface. This surface is surrounded by a higher temperature surface usually operated in the temperature range of 70 to 130 K, which provides radiation shielding to the lower temperature surface. In addition, this higher temperature surface serves as a pumping site for higher boiling point gases such as water vapor. The radiation shielding generally comprises a housing which is closed except at a frontal array positioned between the primary pumping surface and the chamber to be evacuated. In operation, high boiling point gases such as water vapor are condensed on the frontal array. Lower boiling point gases pass through that array and into the volume within the radiation shielding and condense on the primary pumping surface. A surface coated with an adsorbent such as charcoal or molecular sieve operating at or below the temperature of the primary pumping surface may also be provided in this volume to remove the very low boiling point gases. With the gases thus condensed and or adsorbed onto the pumping surfaces, only a vacuum remains in the work chamber.

In systems cooled by closed cycle coolers, the cooler is typically a two stage refrigerator having a cold finger which extends through the rear of the radiation shielding. The cold end of the second coldest stage of the cryocooler is at the tip of the cold finger. The primary pumping surface or cryopanel which is connected to a heat sink at the coldest end of the second stage of the coldfinger may be a plain metal surface or an array of metal surfaces arranged around and connected to the second stage heat sink. The primary pumping surface contains the low temperature adsorbent. A radiation shield which is connected to a heat station at the coldest end of the first stage of the coldfinger surrounds the primary cryopumping panel in such a way as to protect it from radiant heat. The radiation shield must be sufficiently spaced therefrom to permit substantially unobstructed flow of low boiling temperature gas from the vacuum chamber to the primary pumping surface. The frontal radiation shield is cooled by the first stage heat sink through the side shield. Typically, the temperature differential across that long thermal path from the frontal array to the first stage heat sink is between 30 and 50 K. Thus, in order to hold the frontal array at a temperature sufficiently low to condense out water vapor, typically less than 130 K, the first stage must operate at between 80 and 100 K.

The heat load which can be accepted by a cryocooler is strongly temperature dependent. At high operating temperatures conventional cryocoolers can accept higher heat loads. Thus, a reduction in the temperature differential between the frontal array and the first stage heat sink will allow an increase in the operating temperature of the first stage heat sink. This will allow the cryocooler to accept a higher heat load while maintaining the frontal array at an acceptable operating temperature. To accomplish this reduction in temperature differential, conventional cryopump designs utilize high conductivity materials such as copper in the radiation shields. The gradient can be further reduced by increasing the cross sectional area of the radiation shielding to thus increase the thermal conductance of that shielding. This increased mass of the shielding adds both weight and cost to the product and disadvantageously increases the cool down time and regeneration time of the cryopump.

An object of this invention is to provide a cryopump which minimizes the temperature differential between a cryopanel and associated heat sink without substantially increasing the mass of the system while at the same time allowing the cryocooler to operate at a higher loading level (higher temperature).

DISCLOSURE OF THE INVENTION

In the primary embodiment of this invention, high conductance thermal struts provide relatively short thermal path from a first stage heat sink to a frontal cryopumping surface. By adding these thermal struts to the system, the surrounding radiation shield need no longer serve as the primary thermal path to the frontal shield. Due to their shorter length, the struts can provide a given conductance between the frontal cryopanel and its heat sink with a lesser mass than would be required by radiation shields serving the same purpose.

To minimize the length of the thermal struts, they may extend through holes in the primary pumping surface. They must be isolated from that surface, as by a clearance, in order to prevent loading of the coldest heat sink by thermally short circuiting of the higher temperature surface and the primary pumping surface. With such a structure, the frontal cryopanel need not be connected to the side radiation shield. With the cryopanel thus supported only by the thermal struts, fabrication is simplified.

In one form of the invention, the higher conductance thermal path between the frontal cryopanel and its corresponding heat is provided by a heat pipe. Due to the very high thermal conductivity of a heat pipe, the length of the pipe is not so critical. The mass of a heat pipe would also be less than that of a corresponding thermal strut further enhancing its application.

A heat pipe extending from a heat sink to its associated cryopanel should generally have a fluid therein which vaporizes and condenses in a temperature range which includes the operating temperature of the cryopanel. However, for more rapid cooling of a cryopanel, a heat pipe may be provided between that cryopanel and a heat sink with which it is not to be associated during steady operation of the system. In that case, the fluid in the heat pipe may be selected so that it condenses out completely at the operating temperature of the heat sink or cryopanel and thus becomes an open thermal circuit when the operating conditions of the system are reached.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

PREFERRED EMBODIMENT OF THE INVENTION

Figure 1:
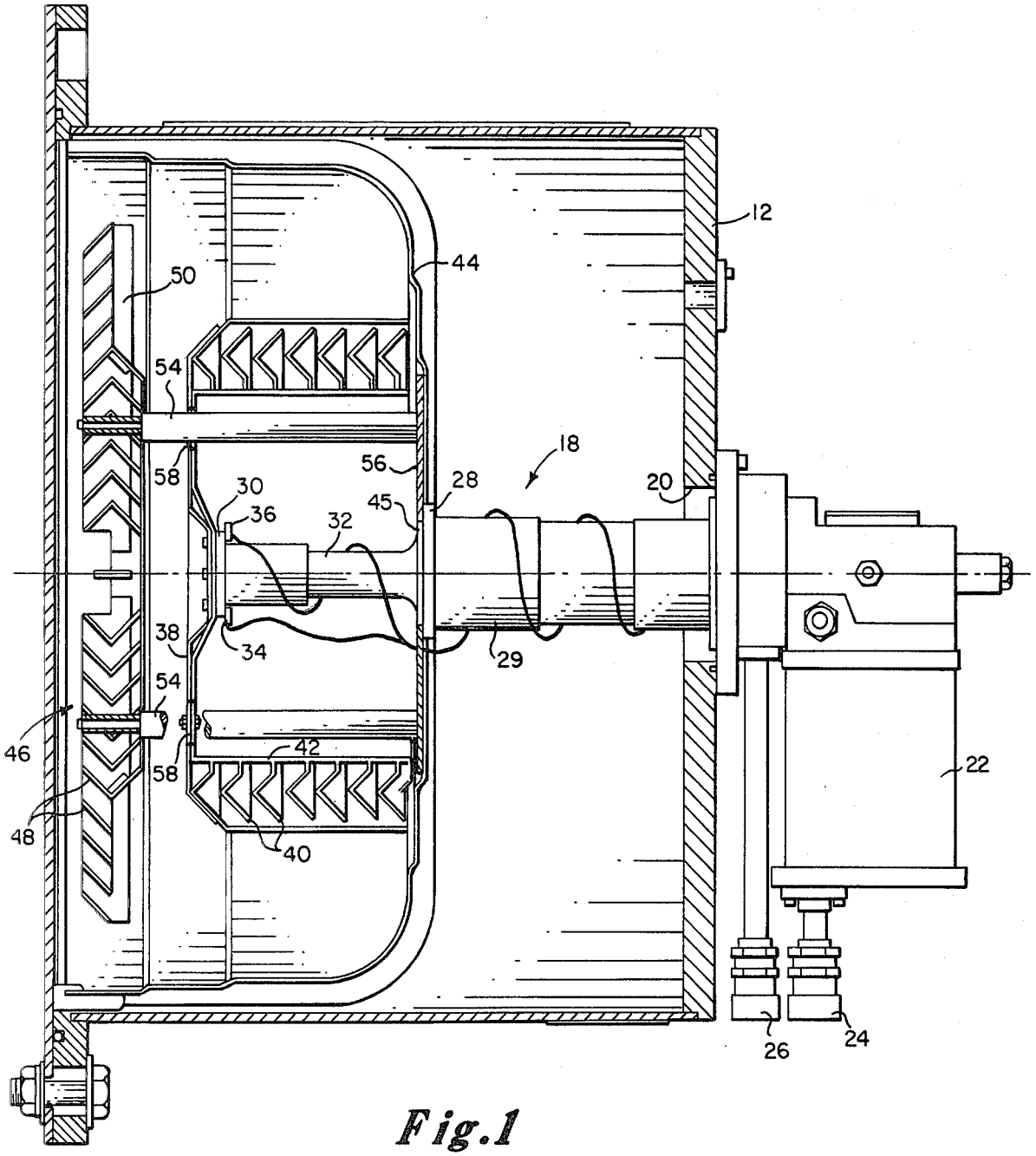
FIG. 1 is a cross sectional view of a cryopump embodying this invention.

The cryopump of FIG. 1 comprises a main housing 12 which is mounted to the wall of a work chamber along a flange 14. A front opening 16 in that housing 12 communicates with a circular opening in the work chamber. Alternatively, the cryopum arrays may protrude into the chamber and a vacuum seal be made at a rear flange. A two stage cold finger 18 of a refrigerator protrudes into the housing 12 through an opening 20. In this case, the refrigerator is a Gifford-MacMahon refrigerator but others may be used. A two stage displacer in the cold finger 18 is driven by a motor 22. With each cycle, helium gas introduced into the cold finger under pressure through line 24 is expanded and thus cooled and then exhausted through line 26. Such a refrigerator is disclosed in U.S. Pat. No. 3,218,815 to Chellis et al. A first stage heat sink, or heat station, 28 is mounted at the cold end of the first stage 29 of the refrigerator. Similarly, a heat sink 30 is mounted to the cold end of the second stage 32. Suitable temperature sensor and vapor pressure sensor elements 30 and 34 are mounted to the rear of the heat sink 30.

The primary pumping surface is a panel mounted to the heat sink 30. This panel comprises a disc 38 and a set of circular chevrons 40 arranged in a vertical array and mounted to disc 38. The cylindrical surface 42 may hold a low temperature adsorbent. Access to this adsorbent by low boiling point gases would be through chevrons 40. The surfaces 38, 40 and 42 can be loosely termed the primary, low temperature cryopanel.

A cup shaped radiation shield 44 is mounted to the first stage, high temperature heat sink 28. The second stage of the cold finger extends through an opening 45 in that radiation shield. This radiation shield 44 surrounds the primary cryopanel to the rear and sides to minimize heating of the primary cryopanel by radiation. The temperature of this radiation shield ranges from about 100 K at the heat sink 28 to about 130 K adjacent the opening 16.

A frontal cryopanel 46 serves as both a radiation shield for the primary cryopanel and as a cryopumping surface for higher boiling temperature gases such as water vapor. This panel comprises a circular array of concentric louvers and chevrons 48 joined by spoke-like plates 50. The configuration of this array need not be confined to circular concentric components. But is should be an array of baffles so arranges as to act as a radiant heat shield and a higher temperature cryopumping panel, while providing a path for lower boiling temperature gases to the primary cryopanel.

In conventional cryopumps, the frontal array 46 is mounted to the radiation shield 44, and the shield both supports the frontal array and serves as the thermal path from the heat sink 28 to that array. The shield 44 must be sufficiently large to permit unobstructed flow of gases to the primary cryopanel. As a result, the thermal path length of that shield from the heat sink 28 to the frontal array is long. To minimize the temperature differential between the frontal array and the heat sink 28, massive radiation shields have been required.

In accordance with this invention, thermal members 54 extends between a plate 56 mounted to the heat sink 28 and the frontal array. Those struts may extend through clearance openings in the primary panel 38 and are thus isolated from that panel, or they may pass outside of the primary pumping surfaces 38, 42. The struts 54 need not serve as radiation shields and are thus able to have a very short length between the heat sink 28 and the cryopanel 46. As a result, a thermal path having a given conductance can be obtained with a much lesser cross sectional area than would be required of the radiation shield if it served as the sole heat flow path. The heat flow path from the heat sink 28 to the center of the cryopanel 46 can be reduced to less than one half the conventional path length through the radiation shield 44. This permits a reduction of 20 to 25 percent in overall mass of the entire array of elements connected to the heat sink 28.

Even greater reduction in mass can be obtained by using heat pipes as the thermal struts 54. Heat pipes are metallic tubes, sealed at each end and evacuated but for a small amount of low boiling temperature liquid and its vapors. Liquid is carried to the warm end of each heat pipe at the frontal array by a wick. Heat input to the heat pipe there causes the liquid to vaporize. That heated vapor is quickly dissipated throughout the heat pipe and thus rapidly carries the heat to the cold end of the heat pipe at the plate 56. There, the vapor condenses, giving off its heat to the heat sink 28. The condensed liquid is then returned to the warm end by the wick. If the cryopump were oriented above the work chamber the condensed liquid would flow to the warm end without need for a wick within the pipes. Even without such a wick, the pipe can be loosely termed a heat pipe.

There is virtually no temperature differential along the length of a heat pipe. Thus, the cryopanel 46 operates at a temperature very close to the operating temperature of the first stage 29 of the refrigerator. As a result, a refrigerator having a first stage operating at near 130 K can be used. Because the thermal load capability of a refrigerator increases with its operating temperature, such a cryopump has a much increased load handling capability.

With a heat pipe, the length of the thermal strut is not so critical. Thus, the heat pipe need not extend through the primary pumping surface 38 and may actually run close to the radiation shield 44. For economic reasons, however, the straight, short heat pipe is preferred. Thus, even where the thermal struts are heat pipes they preferably extend through the surface 38 with a clearance for isolation from that surface.

Figure 3:
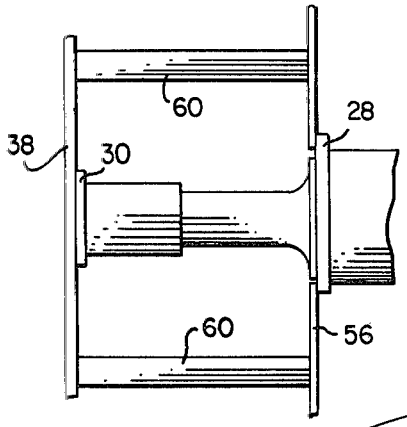
FIG. 3 is a partial cross-sectional view of an alternative arrangement in which a heat pipe serves as a thermal switch.
Figure 2:
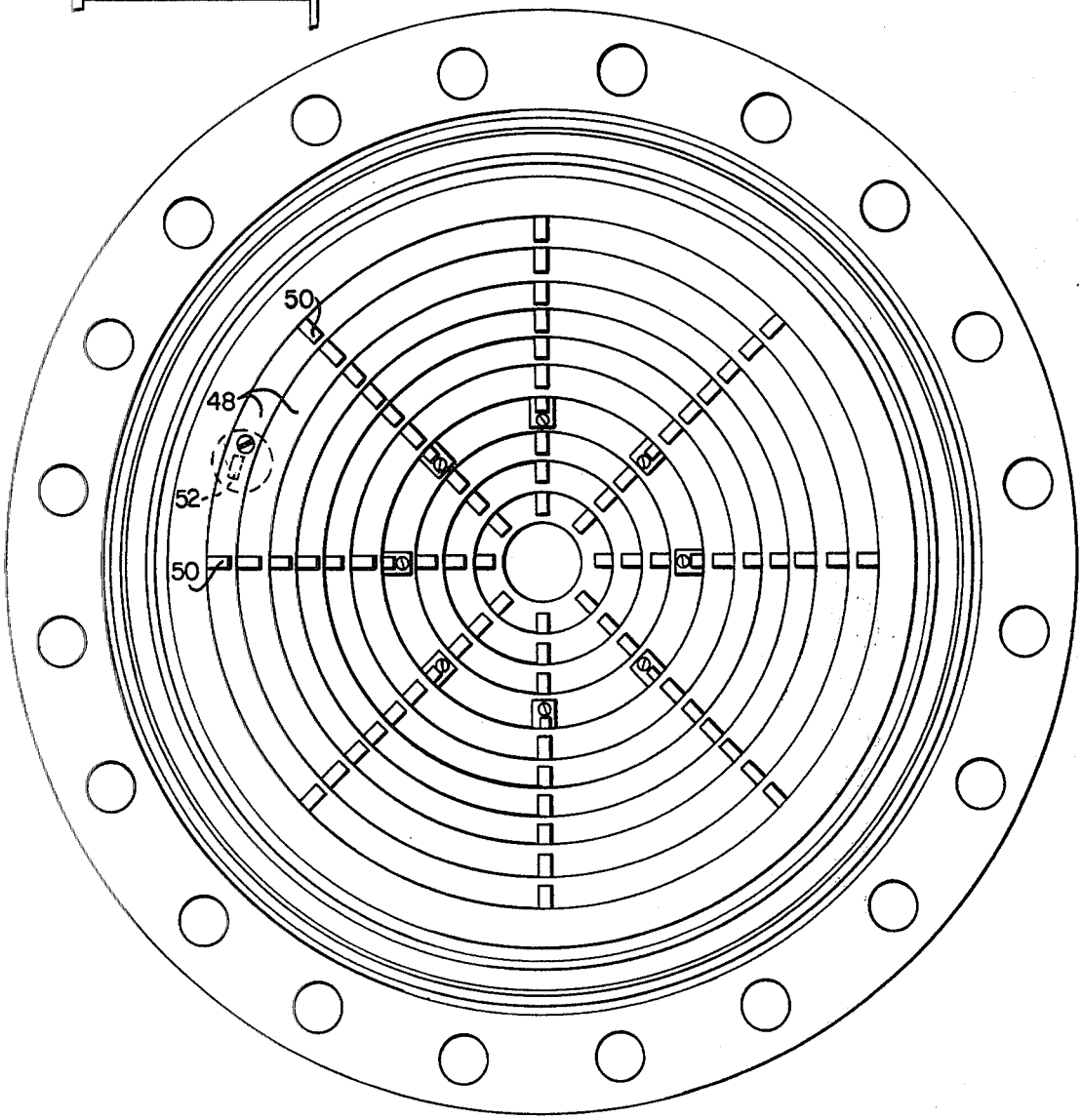
FIG. 2 is a top view of the frontal array of the cryopump of FIG. 1.

FIG. 3 shows an alternative use of a heat pipe in the cryopump. In the system of FIG. 3, heat pipes 60 extends between the first and second stage heat sinks 28 and 30. As the cryopump is cooling down, the primary cryopanel is cooled by both stages of the refrigerator. The heat pipe is designed, however, so that as the temperature of the heat sink 30 approaches its operating temperature, the vapor condenses out of the heat pipe completely. With no vapor to transfer heat along the length of the pipe, the pipe then acts as an open thermal circuit.

While the invention has been particularly shown and described with reference to a preferred embodiment thereof, it will be understood by those skilled in the art that various changed in form and details may be made therein without departing from the spirit and scope of the invention as defined by the appended claims. For example, a closed cycle, two stage refrigerator is shown. A cryopump cooled by an open cycle refrigerant such as liquid nitrogen, hydrogen or helium may also be used. Also combinations of single and two stage closed cycle refrigerators may be used to provide the cooling. Also, a low temperature adsorber may be provided to take out gases which are not condensed at the operating temperature of the primary cryopanel.

We claim:

1. A cryopump comprising a refrigerator having first and second coaxial stages, a primary cryopanel mounted directly to a low temperature heat sink on the second stage, a radiation shield surrounding the primary cryopanel and coaxial with the refrigerator and in thermal contact with a higher temperature heat sink on the first stage, and a frontal cyopanel extending substantially across an entire opening in the radiation shield, the frontal cryopanel being in thermal contact with the first stage but with the second stage positioned between the frontal cryopanel and the first stage, characterized by:

a high conductance heat flow path from the frontal cryopanel to the higher temperature heat sink, that heat flow path being independent of the radiation shield.

2. A cryopump comprising a two stage refrigerator with a heat sink at the cold end of each stage, a primary pumping surface in close thermal contact with the second, coldest stage heat sink, a radiation shield spaced from and, but for a front opening to a vacuum chamber, surround the primary pumping surface and in close thermal contact with the first stage heat sink, the radiation shield being sufficiently spaced from the primary pumping surface to permit gas flow from the vacuum chamber to the primary pumping surface, the gas to be condensed at low temperatures on that pumping surface, and a frontal secondary pumping surface and radiation shield for blocking radiation and con-densing higher condensation temperature gases, the cryopump characterized by:

at least one high thermal conductance thermal strut extending through but out of thermal contact with the primary pumping surface and providing a thermal path from the frontal pumping surface to the first stage heat sink, the thermal path length of the struts being substantially less than that of the radiation shield to provide a substantially lower mass heat flow path fron the frontal pumping surface to the first stage heat sink than that which would be required if the radiation shield served as the sole heat flow path.

3. A cryopump comprising a refrigerator having first and second coaxial stages, a primary pumping surface mounted directly to the second stage, a radiation shield, coaxial with the refrigerator and in thermal contact with the first stage, spaced from and, but for an opening to a vacuum chamber, surrounding the primary pumping surface, the radiation shield being sufficiently spaced from the primary pumping surface to permit gas flow from the vacuum chamber to the primary pump surface, gas to be condensed at low temperatures on that pumping surface, and a frontal, secondary pumping surface and radiation sheild comprising chevron baffles extending substantially across the entire opening to the vacuum chamber for blocking radiation and condensing higher condensation temperature gases, the baffles being in thermal contact with the first stage but with the second stage positioned between the baffles and the first stage, the cryopump characterized by:

a high thermal conductance heat flow path from the high temperature pumping surface to a heat sink through at least one heat flow element which provides negligible radiation shielding, the combined mass of said heat flow elements being substantially less than that which would be required if the radiation shield served as the sole heat flow path.

4. A cryopump as claimed in claim 1, 2, or 3 wherein the high conductance thermal path is provided by at least one heat pipe.

5. A cryopump as claimed in claim 4 wherein the fluid in the heat pipe vaporizes and condenses in a temperature range which extends to less than and about 130 K.

6. A cryopump as claimed in claim 2 or 3 wherein the frontal pumping surface and the side radiation shield are not interconnected.

7. A cryopump as claimed in claim 1 or 3 wherein the high conductance heat flow path extends through but is isolated from the primary pumping surface.

8. A cryopump as claimed in claim 7 wherein the refrigerator to the cryopump is a two stage refrigerator and the heat pipe extends between the first, warmer stage of the refrigerator to a secondary pumping cryopanel.

9. A cryopump as claimed in claim 8 wherein the fluid in the heat pipe vaporizes and condenses in a temperature range which extends to less than about 130 K.

10. A cryopump as claimed in claim 8 wherein the high conductance heat flow element extends through but is isolated from the primary pumping surface.

11. A cryopump comprising a refrigerated heat sink and a cryopanel of extended surface area in heat exchange relationship with the heat sink, characterized by:

at least one heat pipe in close thermal contact with each of the heat sink and cryopanel, the heat pipe having a fluid therein which vaporizes and condenses in a temperature range including the operating temperature of the cryopanel and providing a high conductance thermal path to minimize the temperature differential between the heat sink and cryopanel.

* * * * *